US005104048A

United States Patent [19]

Cecil et al.

[11] Patent Number: 5,104,048

[45] Date of Patent: Apr. 14, 1992

[54] ACCESS DOOR FOR COAL CRUSHER FEED CHUTE

[75] Inventors: Theodore W. Cecil, Gillette; Durel B. Shrum, Wright; Kelly Smith, Gillette, all of Wyo.

[73] Assignee: Atlantic Richfield Company, Los Angeles, Calif.

[21] Appl. No.: 514,626

[22] Filed: Apr. 25, 1990

[51] Int. Cl.[5] ..... B02C 25/00

[52] U.S. Cl. ..... 241/34; 241/283

[58] Field of Search ..... 241/30, 34, 285 R, 285 A, 241/285 B, 186 R, 283, 82, 236, 35, 36; 222/322, 333, 334, 409, 263

[56] References Cited

U.S. PATENT DOCUMENTS

| | | | |
|---|---|---|---|
| 779,205 | 1/1905 | Campbell | 241/283 |
| 879,581 | 2/1908 | Pettengill | 241/34 |
| 1,748,046 | 2/1930 | Bullock | 241/34 |
| 4,082,228 | 4/1978 | Paterson et al. | 241/34 |
| 4,449,671 | 5/1984 | Martinez et al. | 241/283 X |
| 4,529,134 | 7/1985 | Williams | 241/36 X |

*Primary Examiner*—Mark Rosenbaum
*Attorney, Agent, or Firm*—Michael E. Martin

[57] ABSTRACT

A coal crushing facility having a coal crusher with an inlet feed chute and a feeding mechanism interposed between the crusher and a storage hopper wherein a top wall of the feed mechanism discharge chute includes a hinged door which is responsive to backup of coal in the crusher inlet chute to open slightly and effect operation of a proximity switch to shut down the feed motor. The circuit for the feed motor control may have a manual switch interposed therein to effect restarting of the feed motor only at will. The door may be moved to a full open position to provide a large opening to bring into operation a hydraulic breaker for breaking up large chunk coal and unclogging the feed chute. The door may be moved between open and closed positions by a motor operated winch.

9 Claims, 1 Drawing Sheet

ACCESS DOOR FOR COAL CRUSHER FEED CHUTE

BACKGROUND OF THE INVENTION

1. Field of the Invention

The present invention pertains to an arrangement in a feed mechanism for feeding particulate material, such as coal, to a crusher wherein the feed mechanism has an access door which may be manually or automatically opened in response to backup of material in the crusher inlet chute to shut down the feed mechanism and to provide access for clearing clogged oversized material from the crusher inlet chute.

2. Background

In the art of coal crushing and similar types of bulk material processing systems, the crusher apparatus is typically supplied with material to be processed from a storage hopper by way of a feed mechanism which conveys the material to an inlet or feed chute to the crusher apparatus. In many instances, the size of the pieces or chunks of material to be crushed and the feed rate tend to overfeed the crusher resulting in a clogged condition which then necessitates shut-down of the crusher and the feed mechanism, expending considerable effort to unblock the crusher inlet chute and reduce the particle size so that the crusher may be restarted. Prior art arrangements of crusher apparatus have been difficult to gain access to in order to remove material from a clogged inlet chute and this lack of suitable access also sometimes requires personnel to be exposed to hazardous working conditions.

Moreover, the clogging of the primary crusher feed, of course, interrupts crusher operation which, in high volume coal or rock production, is generally intolerable. For example, the primary crushers in a large open-pit mine operating in the Powder River Basin of Wyoming reduce coal particles to approximately seven inches maximum dimension or less. These crushers are in a production or process stream which delivers coal to unit trains at a significant rate. If a crusher becomes plugged or inoperable, under prior art arrangements, up to twelve hours of coal production may be lost from such a crusher thereby reducing mine output significantly. Accordingly, correction of a problem associated with prior arrangements of coal crushing apparatus is important. The present invention overcomes deficiencies with the prior art arrangement as will be further understood upon reading the description which follows.

SUMMARY OF THE INVENTION

The present invention provides an improved arrangement of a feed path for a coal or rock crusher wherein the crusher inlet feed path or chute is more accessible for clearing a clogged material condition and for minimizing the chance of severely clogging the crusher inlet.

In accordance with one important aspect of the present invention a coal crusher apparatus is provided with an inlet chute and a feed mechanism for conveying coal to the crusher from a storage hopper or the like and wherein an access door is provided for entry into the feed path or inlet chute to remove or break up clogged coal or rock in the chute.

In accordance with another important aspect of the present invention, a coal or rock crusher apparatus is provided with an inlet chute wherein in the event of a slow-down in the crusher inlet feed rate an access door is partially moved by the backup of material in the chute and such movement is sensed by a control circuit which shuts down a coal feed mechanism to reduce the chance of complete clogging or plugging of the material feed path. The control circuit includes a proximity switch which is mounted in proximity to the access door and responds to slight movement of the door due to accumulation of material in the feed path to effect shut down of the feed mechanism.

Several advantages are realized by the present invention. The arrangement of the access door and the control circuit which senses minor movement of the door in response to accumulation of material in the feed or inlet chute, minimizes clogging of the chute to the extent that complete shut-down of the system and manual unclogging is often not required. The arrangement of the access door thus provides for early detection of an overfeed condition. The provision of the access door is such that a large area of the crusher feed chute is easily accessible by suitable power operated percussion tools such as picks or hammers to effect unclogging of material in the feed chute. Time required to unplug the crusher feed path is significantly reduced and the requirement for operating personnel to actually climb into the feed chute is significantly less than with prior art practices.

Those skilled in the art will recognize the above-described advantages and superior features of the present invention together with other important aspects thereof upon reading the detailed description which follows in conjunction with the drawing.

DESCRIPTION OF A PREFERRED EMBODIMENT

Figure 3:
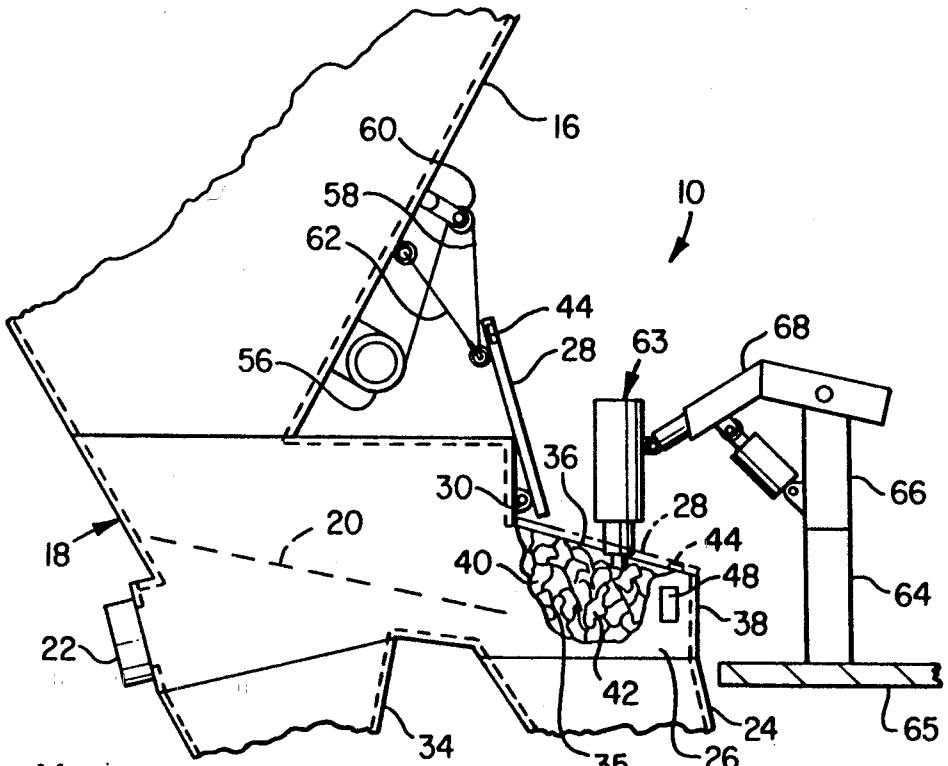
FIG. 3 is a side elevation of a portion of the system illustrated in Figure on a larger scale and showing the access door in the open position.

In the description which follows, like parts are marked throughout the specification and drawing with the same reference numerals, respectively. The drawing figures are not necessarily to scale and certain elements are shown in somewhat schematic or generalized form in the interest of clarity and conciseness.

Referring to Figure there is illustrated a coal crushing system or facility, generally designated by the numeral 10, and disposed within a below-grade concrete housing 12. The facility 10 includes a coal-receiving hopper 14 which may receive lump or chunk coal from suitable dumper trucks, not shown, which discharge their load through a grate 15 into the hopper. The hopper 14 has a bottom discharge portion 16 which discharges the chunk coal into a feeder 18. The feeder 18 may be of a type having a vibratory conveyor mechanism, schematically represented by the numeral 20, operably driven by suitable motor means 22 for feeding the chunk coal to a chute 24 for a primary crushing apparatus 25. The feeder 18 may be of a type commercially available such as from FMC Corporation as their model MF 2000. Chunk coal which is traversed across the vibrating conveyor mechanism 20 is discharged into the chute 24 which has an inlet portion 26 with a sloping top wall formed by a door 28 which is hinged at hinge means 30, see FIG. 3 also. The crusher apparatus 25 has a bottom discharge chute 31 which discharges crushed coal into a suitable conveyor 32. Coal particles which are of a size which may bypass the crusher drop through the feeder conveyor mechanism 20 into a bypass chute 34 and are discharged directly to the conveyor 32 for removal from the crushing process.

Figure 2:
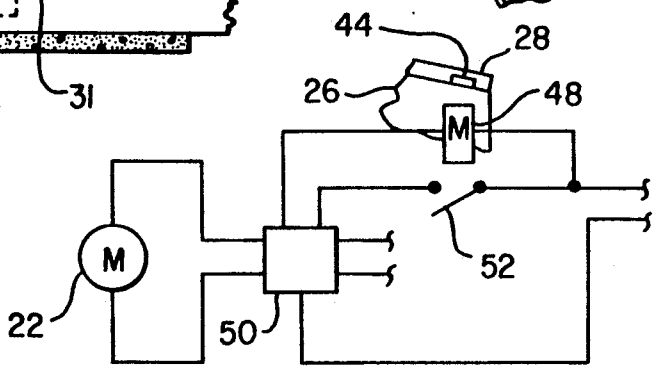
FIG. 2 is a schematic diagram of a control circuit for the present invention.

Referring further to FIG. 3, the chute 26 is made up of opposed sidewalls 35 and 36 and an endwall 38 which guides the chunk coal into the crusher inlet chute 24. In FIG. 3, the door 28 is shown in the open position and by alternate position lines in the closed position like that illustrated in FIG. 1. If chunk coal 40 backs up in the space 42 defined by the chute 26 as a result of clogging the inlet chute 24, the continued accumulation of coal will tend to open the door 28 at least slightly. In this regard, the door 28 is provided with suitable means 44 comprising a tab of magnetic material attached to one side edge of the door. In response to movement of the door 28 and the tab 44 away from the closed position, a proximity switch 48, see FIG. 2 also, is actuated to effect operation of a control circuit 50 to shut off power to the feed motor 22. In this way, significant over-feeding of chunk coal into the crusher 26 is avoided. Once the motor 22 has been shut off by operation of the switch 48, it may not be restarted without closing a manual switch 52 so that only purposeful restarting of the motor 22 may occur.

Figure 1:
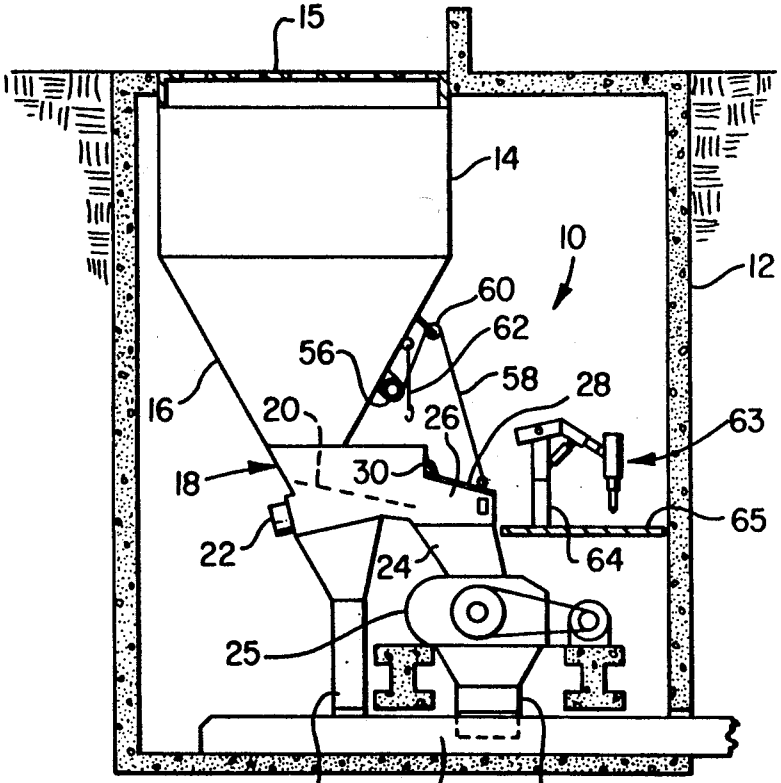
FIG. 1 is a side elevation of a coal crushing facility including the present invention.

The door 28 is also operable to be moved to the full open position by operation of a suitable motor-driven winch 56 supported on the hopper discharge portion 16 and connected to the door 28 by an elongated cable 58. The cable 58 is suitably trained through a standing block 60 also connected to the hopper discharge portion 16. A manually attachable cable 62 is adapted to be interconnected between the hopper portion 16 and the door 28, as illustrated in FIG. 3, to hold the door in the open position. If the chute 24 and the chute 26 become clogged with chunk coal or extra large chunks are lodged in the chute portion 26, these may be broken up and the clogging may be freed by a power-operated percussion tool such as a hydraulic breaker or pick, generally designated by the numeral 63. The pick 63 is mounted on a suitable positioning mechanism including a support pedestal 64 disposed on an intermediate level deck 65 of the crusher facility 10, which pedestal has a pivotable support member 66 for supporting a telescoping support arm 68. As shown in FIG. 1, when the hydraulic pick 63 is not in use, it is pivoted to the retracted position shown. However, when the door 28 is moved to the full open position as shown in FIG. 3, the pick 63 may be extended into the space 42 and the chute 24 for use in breaking up the chunk coal 40 to unblock the feed path leading to the crusher 25.

Operation of the crushing facility and the chute access door 28 is believed to be readily understandable from the foregoing description. However, briefly, when the facility 10 is operating to crush chunk coal by conveying or feeding coal from the hopper 14 by way of the feed mechanism 18 to the crusher inlet chute 24, if the crusher 25 should become choked or clogged or otherwise cause coal backup in the chute 24 and the feed chute 26, the chunk coal 40 will tend to urge the door 28 to an open position to effect operation of the switch 48 to shut down the feed motor 22. If shutoff of the feed motor 22 results in unclogging or unblocking the feed path provided by the chutes 26 and 24, the feed motor may be restarted by manually actuating the switch 52. However, if the feed path does not become unblocked or the crusher 25 is choked and stalled, for example, the winch 56 is actuated by suitable controls, not shown, to open the door 28 to the position shown in FIG. 3 whereupon the hydraulic pick 63 may be pivoted into position to begin breaking up the large chunks of coal 40 in the feed path to unblock the chute 24 and the chute 26. Upon clearing of the feed path, the pick 63 may be retracted to the position shown in FIG. 1, the door 28 closed and the switch 52 actuated to commence operation of the feed mechanism 18 once again. Of course, while the door 28 is in the open position, it may be hooked by the cable 62 to hold the door in an open position in the event that personnel are working in proximity to the opening provided by the door 28.

The components described herein may be manufactured using conventional materials and elements used in conjunction with coal crushing or rock crushing equipment. The chunk coal 40 may, of course, be removed by hand from the feed path or by a portable percussion tool, not shown. However, the provision of the pedestal mounted hydraulic breaker or pick 63 in the arrangement illustrated is certainly more advantageous. Moreover, the provision of the door 28 and a feed motor control operable by the proximity switch 48 minimizes the plugging of the inlet chute 24, 26 to the crusher 25. However, if such a condition does occur, virtually the entire top of the crusher feed chute is made accessible by raising the door 28 and the hydraulic pick or breaker 63 may be put into operation in a short period of time. Accordingly, the length of time required to unplug the feed path to the crushing apparatus 25 is substantially reduced thanks to the provision of the large open access area provided by the door 28 and the provision of the hydraulic pick 63 mounted on the telescoping arm 68. Although a preferred embodiment of the present invention has been described in detail herein, those skilled in the art will recognize that various substitutions and modifications may be made to the embodiment described without departing from the scope and spirit of the invention as recited in the appended claims.

What is claimed is:

1. In a coal-crushing facility including a coal crusher, and a feed chute for conveying coal to said crusher, the improvement comprising:

door means comprising at least part of a top wall of said feed chute disposed for movement in response to accumulation of coal in said feed chute and wherein said coal acts directly on said door means with sufficient force to move said door means from a closed condition to at least a slightly open condition; and means responsive to movement of said door means to effect interruption of feeding of coal to said crusher.

2. In a coal crushing facility including a coal crusher, and a feed chute for conveying coal to said crusher, the improvement comprising:

door means forming a movable wall of said feed chute disposed for movement in response to accumulation of coal in said feed chute from a closed condition to at least a slightly open condition; and a proximity switch disposed in proximity to said door means and responsive to movement of said door means to effect interruption of feeding of coal to said crusher.

3. The invention set forth in claim 2 including:

a feed mechanism for feeding coal to said crusher, said feed mechanism including motor means, and said proximity switch is interposed in a circuit for controlling the operation of said motor means to effect shutoff of said motor means and feeding of coal to said crusher.

4. The invention set forth in claim 3 including:

means for moving said door means to a position to provide access to said chute for clearing coal clogged in said chute.

5. The invention set forth in claim 4 wherein:

said means for moving said door means comprises a motor-operated winch connected to said door means by flexible cable means.

6. The invention set forth in claim 3 including power operated breaker means mounted adjacent to said feed chute and movable into a position to engage coal in said feed chute when said door means is in an open position.

7. In a coal crushing facility including a coal crusher, and a feed chute for conveying coal to said crusher, the improvement comprising:

door means comprising at least part of a top wall of said feed chute;

means for moving said door means to a position to provide access to said chute for clearing coal clogged in said chute; and power operated breaker means mounted adjacent to said feed chute and movable into a position to engage coal in said feed chute when said door means is in an open position.

8. The invention set forth in claim 7 including a proximity switch disposed in proximity to said door means and responsive to movement of said door means to effect interruption of feed of coal to said crushing apparatus.

9. The invention set forth in claim 8 including:

a feed mechanism for feeding coal to said crusher, said feed mechanism including motor means, and said proximity switch is interposed in a circuit for controlling the operation of said motor means to effect shutoff of said motor means and feeding of coal to said crusher.

* * * * *